US006769890B2

(12) United States Patent
Vigano'et al.

(10) Patent No.: US 6,769,890 B2
(45) Date of Patent: Aug. 3, 2004

(54) GAS ROTARY SCREW COMPRESSOR

(75) Inventors: Danilo Vigano', Stezzano (IT); Umberto Tomei, Villanova di Castenaso (IT); Gabriele Di Blasio, Ortona (IT)

(73) Assignee: Samputensili S.P.A., Bologna (IT)

( * ) Notice: Subject to any disclaimer, the term of this patent is extended or adjusted under 35 U.S.C. 154(b) by 0 days.

(21) Appl. No.: 10/037,148

(22) Filed: Dec. 21, 2001

(65) Prior Publication Data

US 2002/0187064 A1 Dec. 12, 2002

Related U.S. Application Data

(63) Continuation of application No. PCT/IT00/00260, filed on Jun. 23, 2000.

(30) Foreign Application Priority Data

Jun. 23, 1999 (IT) ..... B099A0343

(51) Int. Cl.[7] ..... F01C 1/16

(52) U.S. Cl. ..... 418/201.3; 418/97; 418/178; 418/201.1

(58) Field of Search ..... 418/201.1, 178, 418/201.3, 97

(56) References Cited

U.S. PATENT DOCUMENTS 3,311,291 A * 3/1967 Surdy ..... 418/201.1
3,975,123 A * 8/1976 Schibbye ..... 418/97
4,478,054 A 10/1984 Shaw et al.
4,488,858 A 12/1984 Glanvall
4,781,553 A * 11/1988 Nomura et al. ..... 418/201.1
5,314,321 A * 5/1994 Yamamoto et al. ..... 418/178
5,401,149 A * 3/1995 Tsuru et al. ..... 418/178

FOREIGN PATENT DOCUMENTS

| | | | | |
|---|---|---|---|---|
| DE | 3708200 A1 | | 3/1987 | |
| DE | 4426761 A1 | | 7/1994 | |
| JP | 55019923 | | 2/1920 | |
| JP | 52060416 A | * | 5/1977 | ..... F04C/17/12 |
| JP | 55025529 A | * | 2/1980 | ..... F04C/29/02 |
| JP | 58044289 | | 3/1983 | |
| JP | 59176490 | | 10/1984 | |
| JP | 61197788 A | * | 9/1986 | ..... F04C/18/16 |

* cited by examiner

*Primary Examiner*—Thomas Denion
*Assistant Examiner*—Theresa Trieu
(74) *Attorney, Agent, or Firm*—Conley Rose, P.C.

(57) ABSTRACT

A gas rotary screw compressor (1), in particular, for cooling gas suitable for low-power systems, the compressor having a casing (1*a*) having an intake conduit (6) and a delivery conduit (7); and the casing (1*a*) having, internally, a three-dimensional region shaped to follow the outer profile of the helical teeth (11*b*) of a male rotor (11) and the helical teeth (12*b*) of a female rotor (12), so as to define a first intake chamber (45) to minimize the load losses of the gas stream and so fill the casing (1*a*) with a maximum quantity of gas.

30 Claims, 11 Drawing Sheets

1
1a
13
33
48
32
4
36
37
17
34
38a
38
40
39
38b
41
25
27
49
42
51
12
X2
47
22a
2
45
Pc
53
26
24
16
46
21
28
Ri
5a
5
29
28
19
X1
53
1a
10
45
Pc
22a
11
22
50
23
42
20
41
3
38b
39
30
40
38
31
38a
13
1a
33
48
32
4
36
37
17
34
38a
38
40
39
38b
41
25
27
49
42
51
1a

GAS ROTARY SCREW COMPRESSOR

CROSS-REFERENCE TO RELATED APPLICATIONS

This is a continuation of PCT/IT00/00260 with an international filing date of Jun. 23, 2000 (23.06.2000) which claims priority from BO99A000343 and has a priority date of Jun. 23, 1999 (23.06.1999).

STATEMENT REGARDING FEDERALLY SPONSORED RESEARCH OR DEVELOPMENT

Not applicable

TECHNICAL FIELD

The present invention relates to a gas rotary screw compressor, in particular, for low-power air conditioning or refrigeration systems.

BACKGROUND ART

Rotary compressors normally comprise a casing housing a male rotor meshing with a female rotor. Such compressors, however, are used for handling large quantities of gas, in particular, cooling gas such as Freon.

For low-power (3–7 hp) applications, reciprocating compressors have always been used on account of the problems encountered in adapting rotary compressors to low-power systems.

One of the main problems encountered when designing a rotary compressor for low-power, e.g. 3–7 hp, air conditioning or refrigeration systems is achieving optimum fill of the compressor to ensure an acceptable degree of efficiency. That is to say, difficulty is encountered in initiating the intake stage of compressors operating at fairly low male rotor rotation speeds; and, if severe load losses occur at the start of the intake stage—due to poor design of the conduits supplying gas to the rotors of the compressor—the gas expands. Both the above result in impairment of the fill factor of the compressor, which becomes more noticeable as the mass of gas being handled gets smaller. Moreover, if the gas supply conduits, the male and female rotors, and the gas/lubricant mixture discharge conduits are not designed properly, there is a danger the rotors may even operate like a fan and feed the gas, which should be aspirated, back to the supply conduits.

DISCLOSURE OF INVENTION

It is an object of the present invention to provide a gas rotary screw compressor designed to eliminate the aforementioned drawbacks.

According to the present invention, there is provided a gas rotary screw compressor, in particular, for low-power air conditioning or refrigeration systems, as described and claimed in claim 1.

The gas compressed by the screw compressor could be any kind of gas, in particular, Freon or air.

BRIEF DESCRIPTION OF THE DRAWINGS

Two non-limiting embodiments of the present invention will be described by way of example with reference to the accompanying drawings, in which.

BEST MODE FOR CARRYING OUT THE INVENTION

Figure 1:
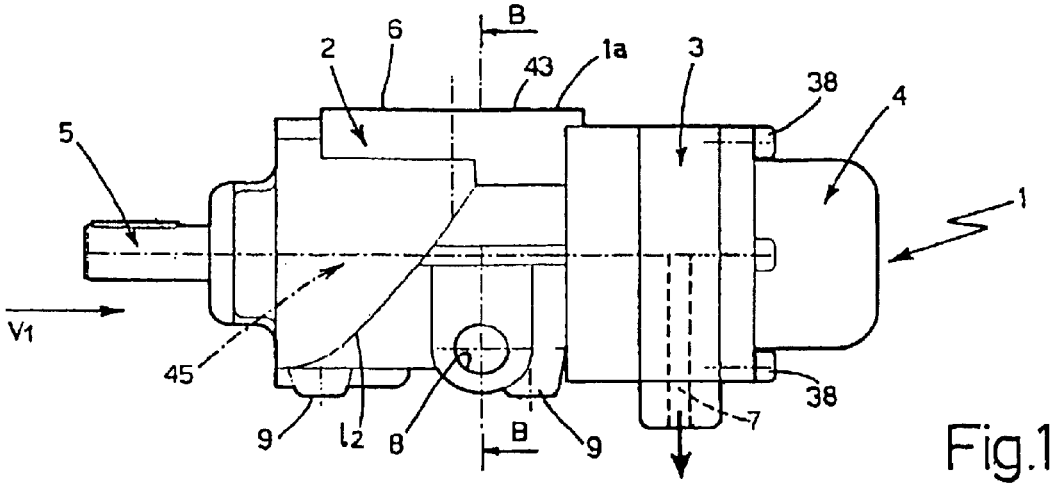
FIG. 1 shows a side view of the compressor according to the present invention, which comprises three main bodies—in the example shown, a rotor body, a delivery body, and a lateral cover body—ideally defining an outer casing.
Figure 2:
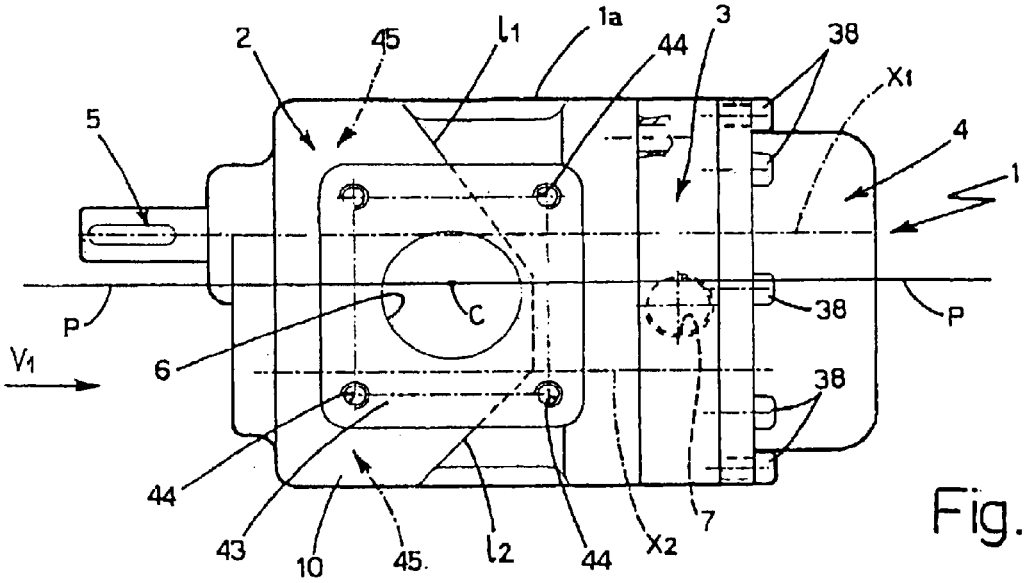
FIG. 2 shows a top plan view of the FIG. 1 compressor.
Figure 3:
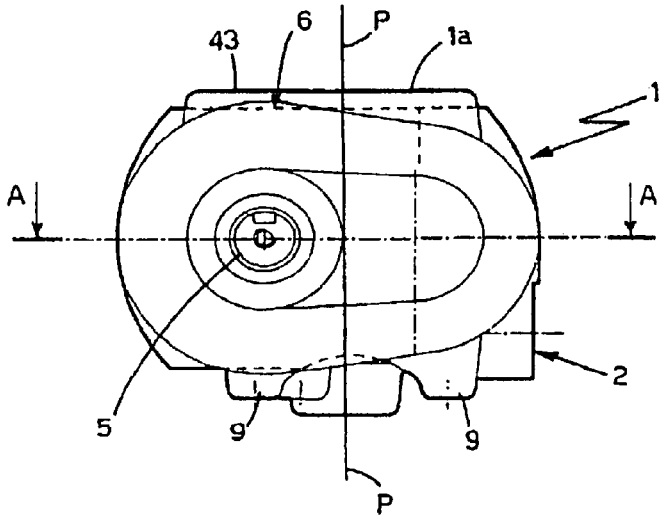
FIG. 3 shows a front view, in the direction of arrow $V_1$, of the FIG. 1 compressor.

Number 1 in FIGS. 1–3 indicates a gas rotary screw compressor according to the present invention. In particular, compressor 1 is particularly suitable for compressing any cooling gas for low-power air conditioning or refrigeration systems.

Compressor 1 comprises an overall casing 1*a* and may be divided ideally into three bodies. More specifically, compressor 1 comprises a rotor body 2, a delivery body 3 and a lateral cover body 4, which are arranged in series and made integral with one another by mechanical fastening means.

FIGS. 1–3 also show a shaft 5 for transmitting motion from a drive assembly (not shown) to rotary screw compressor 1; a gas intake conduit 6; a delivery conduit 7 for the compressed gas; and an injection conduit 8 for injecting a liquid lubricant for lubricating the rotors housed inside rotor body 2 and meshing as described in detail later on.

The overall casing 1*a* comprises three external feet 9, which may be provided with respective internal threads by which to fasten compressor 1 as a whole to a supporting frame of any type (not shown).

As shown in more detail in FIGS. 4–8, rotor body 2 comprises a respective casing 10 which is none other than a portion of overall casing 1*a*, and which houses a male rotor 11 and a female rotor 12. Male rotor 11 comprises a central body 11*a* (FIG. 5); and a number of teeth 11*b* formed integrally with central body 11*a* and which, in the example shown, are helical and five in number. In the embodiment shown, male rotor 11 is also formed integrally with shaft 5 and with a supporting shaft 13 at the opposite end of male rotor 11 to shaft 5. Each tooth 11*b* of male rotor 11 has a passive side 14*a* and an active side 14*b*, and meshes, as described in detail later on, with a corresponding gap 15*a* (FIG. 8) on female rotor 12. In the FIGS. 4–8 embodiment, the twist angle of each tooth 11*b* is 310°, and the twist angle of each tooth 12*b* is (1.2×310°).

Figures 5, 6, 7, 8:
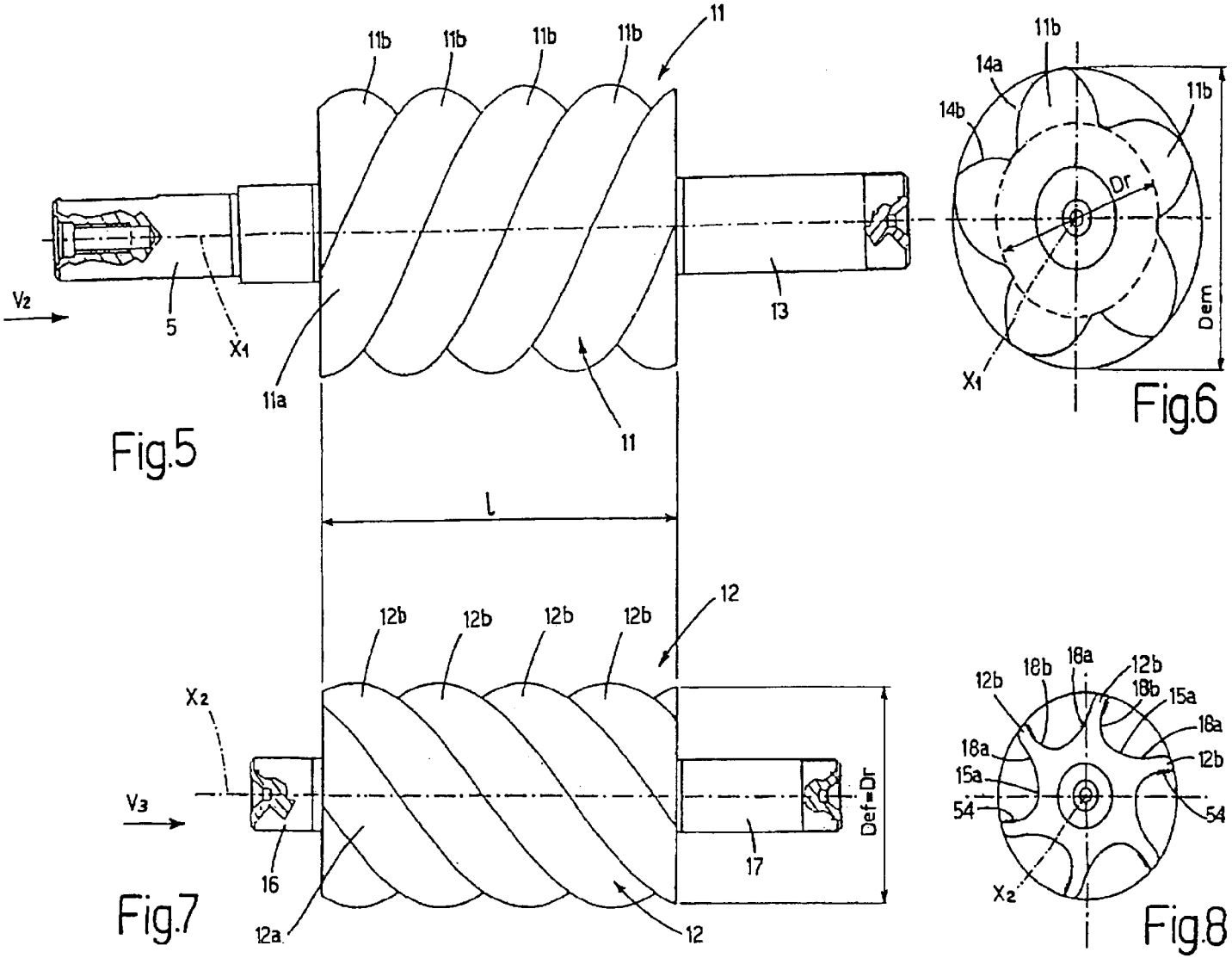
FIG. 5 shows a side view of a male rotor forming part of the FIG. 1 compressor.
FIG. 6 shows a front view, in the direction of arrow $V_2$, of the male rotor in FIG. 5.
FIG. 7 shows a side view of a female rotor forming part of the FIG. 1 compressor.
FIG. 8 shows a front view, in the direction of arrow $V_3$, of the female rotor in FIG. 7.

With reference to FIGS. 7 and 8, female rotor 12 is formed integrally with two supporting shafts 16 and 17 at opposite ends of female rotor 12, and also comprises a central body 12*a* on which are formed integrally a number of teeth 12*b* which, in the embodiment shown, are also helical, are six in number, and each adjacent pair of which defines a respective gap 15*a*. Gaps 15*a* are also six in number and, as stated, are engaged by teeth 11*b* of male rotor 11 at the gas compression stage. Each tooth 12*b* of female rotor 12 also comprises a passive side 18*a*; and an active side 18*b* which contacts a corresponding active side 14*b* of a corresponding tooth 11*b* on male rotor 11 at said compression stage.

Figure 4:
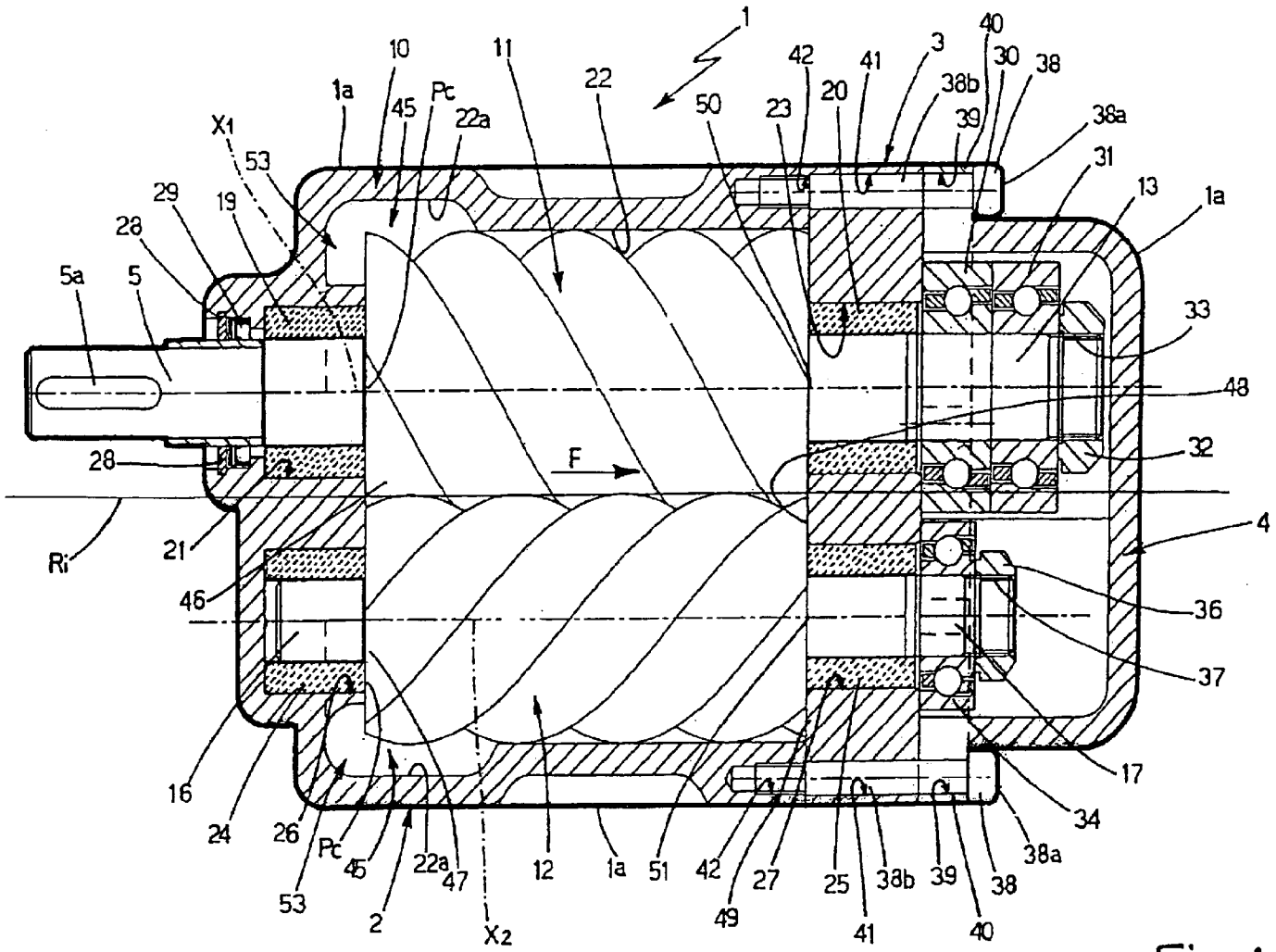
FIG. 4 shows, to a different scale, a longitudinal section A—A of the FIG. 3 compressor.

As shown in FIG. 4, each of shafts 5, 13 formed integrally with male rotor 11 rests on a respective supporting member 19, 20 with a low coefficient of friction. Supporting member 19 is housed inside a respective seat 21 formed on the inner surface 22 of casing 10 of rotor body 2, while supporting member 20 is housed in a respective seat 23 formed in delivery body 3 (see also FIGS. 14, 15).

As shown in FIG. 4, shafts 16, 17 supporting female rotor 12 are housed, at least partially, inside respective supporting members 24, 25 with a low coefficient of friction.

Figure 15:
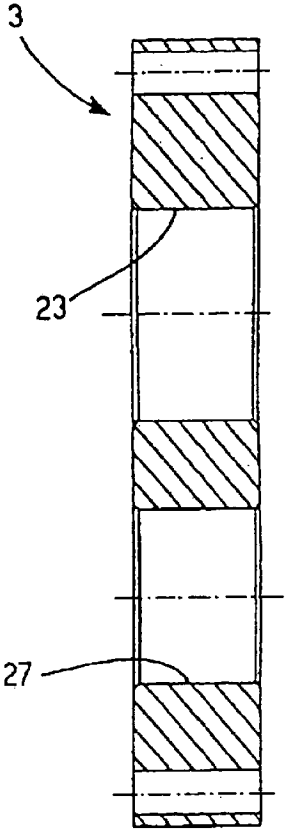
FIG. 15 shows a cross section C—C of the FIG. 14 delivery body.
Figure 14:
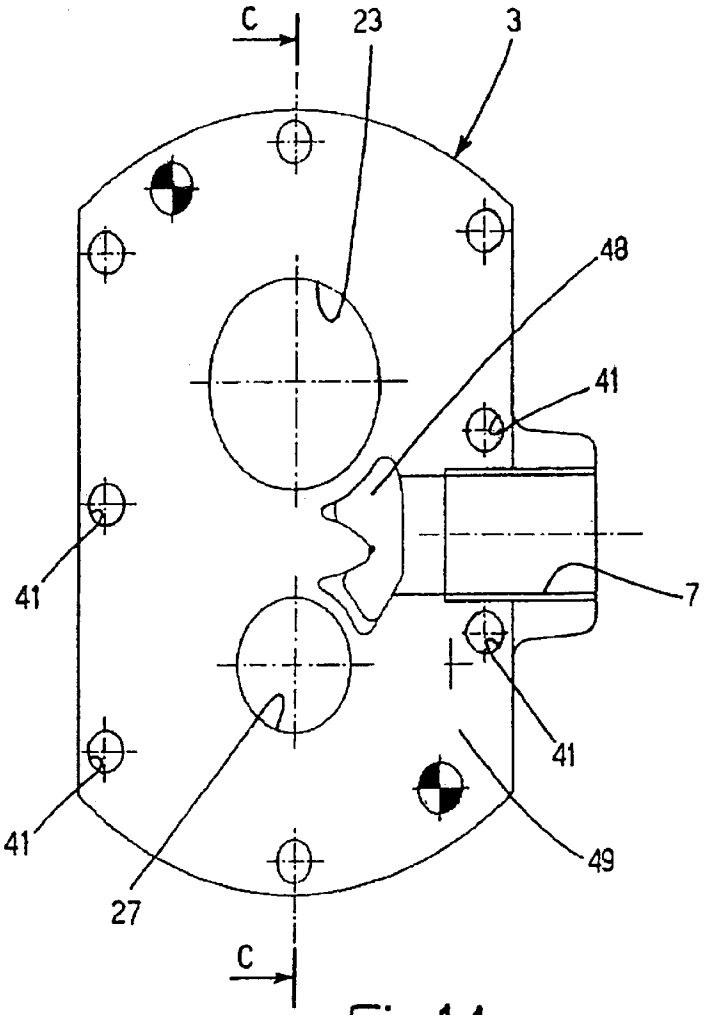
FIG. 14 shows a front view, in the direction of arrow $V_4$, of the FIG. 13 delivery body.

Each supporting member 24, 25 is housed in a respective seat 26, 27; seat 26 is formed on the inner surface 22 of casing 10, and seat 27 in delivery body 3 (see also FIGS. 14, 15).

Figure 16:
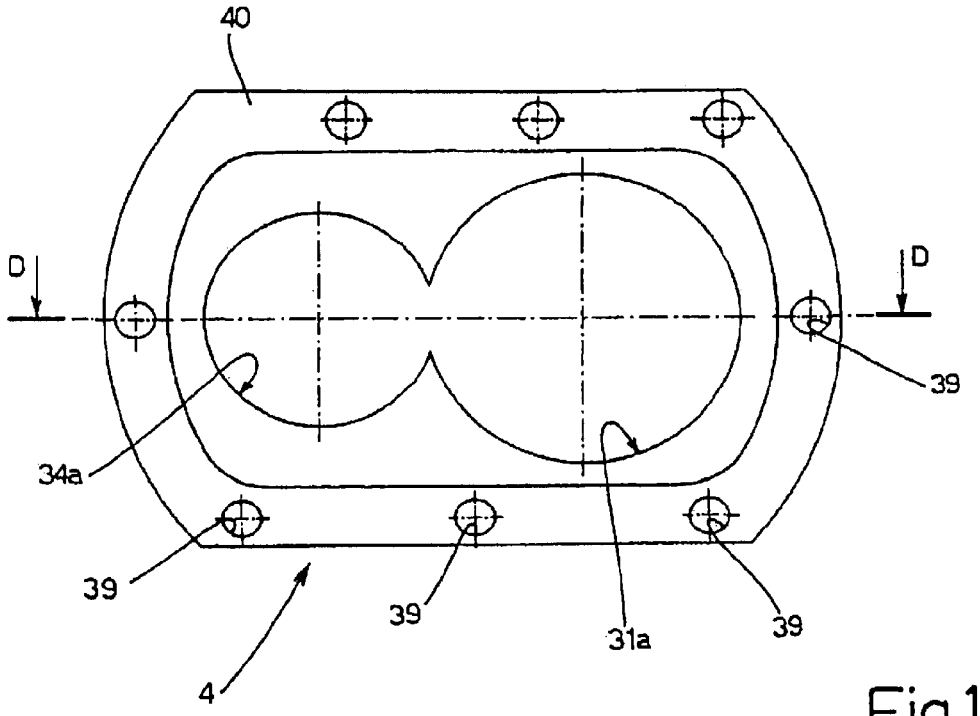
FIG. 16 shows a side view of the lateral cover body.
Figure 17:
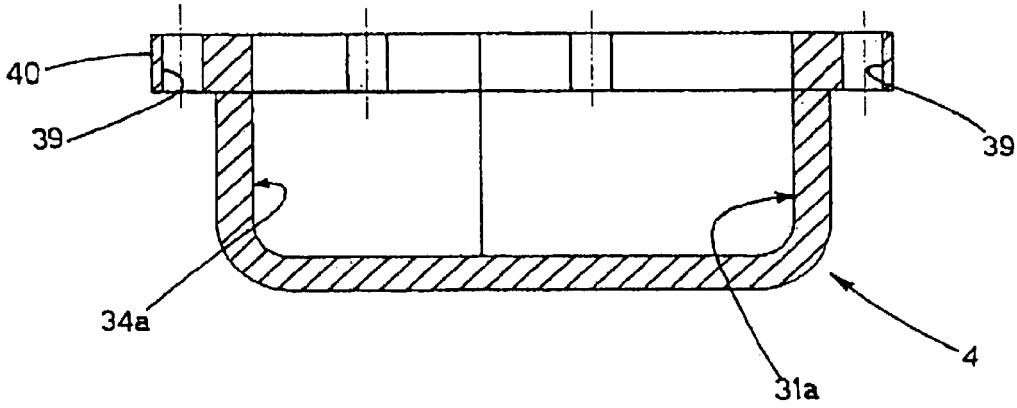
FIG. 17 shows a longitudinal section D—D of the FIG. 16 lateral cover body.

Shaft 5 has a keyway 5*a* for connection to a drive assembly (not shown). The system is sealed by a first retaining ring 28 and a second retaining ring 29, both on the shaft 5 side. In addition to supporting member 20, shaft 13 is also supported by first bearing 30 and second bearing 31 housed in a seat 31*a* formed in lateral cover body 4 (FIGS. 16 and 17). First and second bearings 30, 31 are gripped to each other and both against a face of delivery body 3 by a first internally-threaded ring nut 32 screwed to a threaded end portion 33 of shaft 13.

In addition to supporting member 25, shaft 17 supporting female rotor 12 is also supported by a hall-third bearing 34 housed in a seat 34*a* formed in lateral cover body 4 (FIGS. 16 and 17). Third bearing 34 is gripped against a surface of delivery body 3 by a second internally threaded ring nut 36 screwed to a threaded end portion 37 of shaft 17. First and second ring nuts 32 and 36 are obviously also housed in respective seats 31*a* and 34*a* of body 4, together with respective bearings 30, 31 and 34.

As shown in FIG. 4, the three bodies 2, 3, 4 are made integral with one another by means of eight screws 38, only two of which are shown in FIG. 4, and each of which comprises a head 38*a* and an at least partially threaded shank 38*b*.

Figure 9:
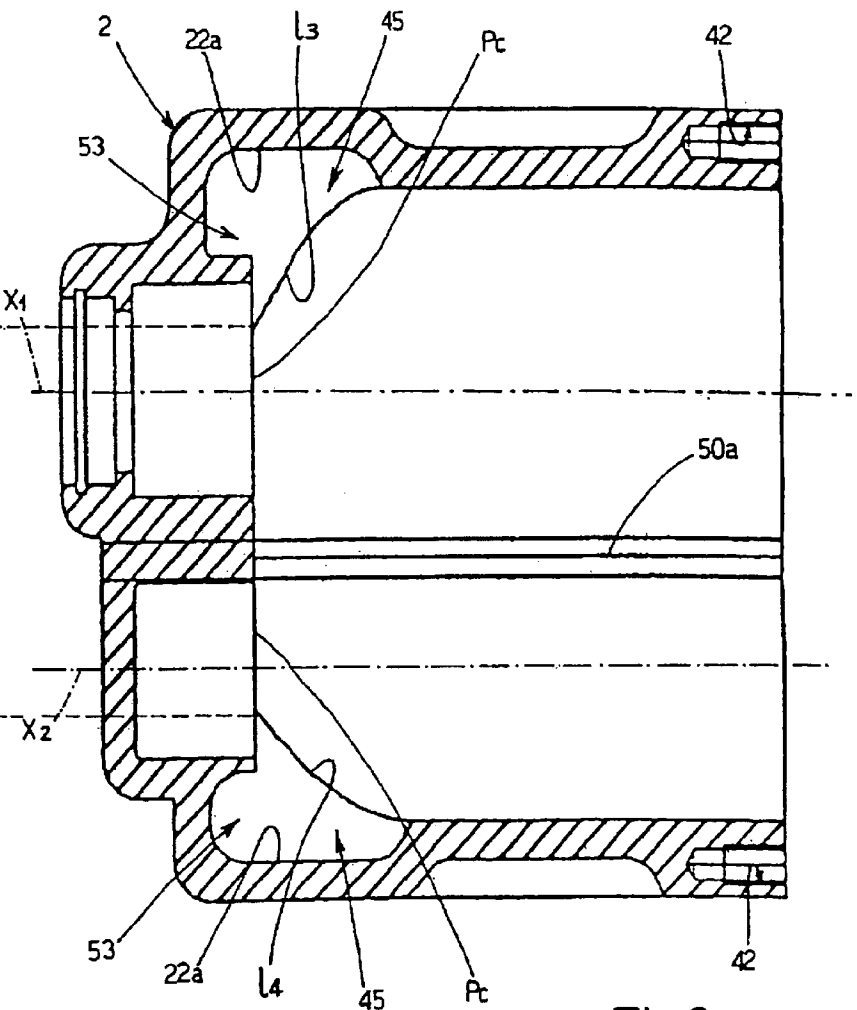
FIG. 9 shows a longitudinal section A—A (not to scale) of the rotor body casing separated from the other two bodies.

To connect bodies 2, 3, 4 to one another, the shank 38*b* of each screw 38 is first inserted through a corresponding through hole 39 formed in a connecting flange 40 of body 4 (FIGS. 16, 17), so that head 38*a* rests on the outer surface of flange 40; is inserted through a corresponding through hole 41 in body 4 (see also FIGS. 14, 15); and is then screwed inside a corresponding threaded dead hole 42 formed in casing 10 of body 2 (see also FIG. 9).

Bodies 2, 3, 4 are thus packed tightly to one another as required.

As shown in FIG. 4, the two rotors 11, 12 have respective longitudinal axes $X_1$, $X_2$ of symmetry parallel to each other.

Male rotor 11 has an outside diameter $D_{em}$ (FIGS. 5, 6) defining an outside circle enclosing the ends of teeth 11*b*; and an inside diameter $D_r$ of an inner rolling circle defined at the bottom of the gaps defined by adjacent pairs of teeth 11*b*.

To enable male rotor 11 to mesh with female rotor 12 the outside diameter $D_{ef}$ (FIGS. 7, 8), defining a circle enclosing teeth 12*b*, of female rotor 12 is equal to rolling diameter $D_r$, so that the ends of teeth 12*b* of female rotor 12 skim the bottom of the corresponding gaps defined by adjacent teeth 11*b* on male rotor 11.

In other words, as male rotor 11 meshes with female rotor 12, teeth 11*b* of male rotor 11 engage corresponding gaps 15*a* on female rotor 12, and each active side 14*b* on male rotor 11 is gradually brought into contact with a corresponding active side 18*b* on female rotor 12 to transmit motion from male rotor 11 to female rotor 12.

As stated, to ensure effective lubrication of the two meshing rotors 11, 12, a continuous stream of liquid lubricant is fed to rotor body 2 along conduit 8.

Between the two rotors 11, 12 is defined a rolling line $R_i$ (FIG. 4), which is simultaneously tangent to the circle of diameter $D_{ef}$ of female rotor 12, and to the rolling circle of diameter $D_r$ of male rotor 11.

The outer surface of casing 10 of rotor body 2 has a flat portion 43 located at intake conduit 6 and having a number of threaded seats 44 by which to screw flat portion 43 easily to a connecting flange of a supply pipe (not shown).

As shown in FIGS. 2 and 3, an ideal plane P passes through the center C of intake conduit 6, perpendicularly to flat portion 43, is parallel to both axis $X_1$ of male rotor 11 and axis $X_2$ of female rotor 12, and contains, among other things, said rolling line $R_i$.

The inner surface 22 of casing 10 of rotor body 2 has a three-dimensional region defining a first intake chamber 45 (see FIG. 4) which, on the outside of casing 10, is in the form of a bulge defined laterally, and in projection, by two lines $1_1$, $1_2$ (FIGS. 1, 2). In addition to inner surface 22, first intake chamber 45 is also defined inside casing 10 by an ideal compression plane $P_c$ (FIG. 4) on which rest respective ends 46, 47 of male and female rotors 11, 12, and by the outer surfaces of rotors 11, 12 indicated, in projection, in FIG. 9 by respective lines $1_3$, $1_4$.

First intake chamber 45 is substantially helical in shape, being so formed as to substantially reproduce the helical shape of teeth 11*b* and 12*b*, as shown by lines $1_1$, $1_2$ on casing 10 (FIGS. 1, 2).

As shown in FIG. 14, delivery body 3 comprises, on a face 49, a delivery outlet 48 which communicates hydraulically with delivery conduit 7 and is closed and opened periodically by the passage of respective ends 50, 51 of rotors 11, 12 (FIG. 4).

The shape of delivery outlet 48 is determined in known manner on the basis of the geometry of rotors 11, 12; and the size of delivery outlet 48 in relation to that of intake conduit 6 depends on the type of gas compressed by compressor 1.

Similarly, also as regards discharge of the compressed gas, compressor 1 may be likened to a two-stroke engine, the delivery outlet 48 of which is opened and closed cyclically by the passage in front of it of end 50 of rotor 11 and end 51 of rotor 12.

Ends 50, 51 rest on face 49 of delivery body 3, so that rotors 11, 12 may be thought of as being confined between compression plane $P_c$ in body 2 at one end, and face 49 of body 3 at the other.

In actual use, the gas flows into casing 10 along intake conduit 6 and in the form of threads substantially parallel to plane P; and, inside casing 10, the threads of gas are first parted by the action of rotors 11, 12 meshing and rotating in opposite directions to each other. After the threads are parted, which occurs at the connection of intake conduit 6 to inner surface 22 of casing 10, the cooling gas, entrained by the rotary movement of rotors 11 and 12, flows along portion 22*a* (FIGS. 4, 9) of surface 22. Rotors 11, 12 begin compressing the cooling gas at compression plane $P_c$ and, besides compressing it, also feed it, in the flow direction indicated by arrow F (FIG. 4), to outlet 48 (FIG. 14) and therefore to delivery conduit 7 communicating with a user device (not shown).

First intake chamber 45 is so formed as to accelerate the incoming cooling gas so that the gas itself initiates the desired pumping effect.

The pumping effect is initiated on reaching a given number of revolutions, which depends on the type of cooling gas, and which, for commonly used cooling gases, is about 2500 rpm.

Figure 11:
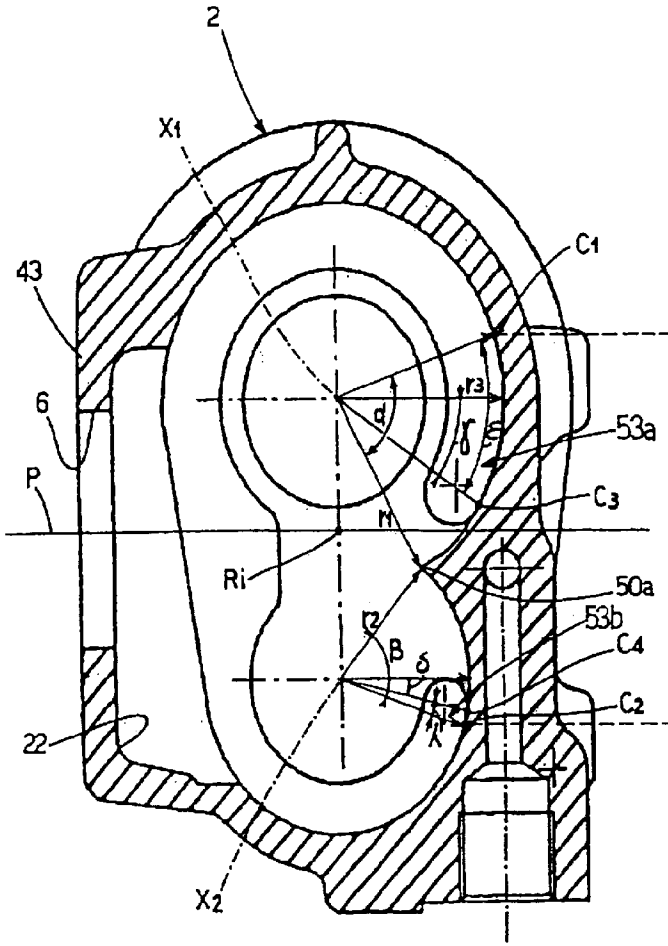
FIG. 11 shows a cross section (not to scale), along line B—B of the FIG. 1 compressor, of the FIG. 9 rotor body casing.

As shown in FIGS. 9 and 11, first intake chamber 45 commences, on the rotor 11 side of compression plane $P_c$, at a point $C_1$ defined by an angle $\alpha$. Angle $\alpha$ is obtained at ideal plane $P_c$ from a radius $r_1$ of a value substantially equal to $D_{em}/2$ (FIGS. 5, 6) and joining axis $X_1$ of rotor 11 (FIG. 11) to a cusp 50*a* formed on inner surface 22 of casing 10 and extending longitudinally along the whole length of rotor body 2 in the direction of axes $X_1$, $X_2$.

For a 310° twist angle of helical teeth 11*b* of rotor 11, angle $\alpha$ has been calculated to equal 70°.

That is, for a 270° to 350° twist angle of teeth 11*b* of rotor 11, angle $\alpha$ has been found to range between 50° and 80°.

Similarly, on the rotor 12 side, first intake chamber 45 commences at a point $C_2$ defined, again at plane $P_c$, by a given angle $\beta$, which is obtained from a radius $r_2$ of a value substantially equal to $D_{ef}/2$, and therefore to $D_r/2$, and joining axis $X_2$ of rotor 12 (FIG. 11) to cusp 50*a*.

For said twist angle (1.2×310°) of female rotor 12, angle $\beta$ equals 55°.

For a (1.2×270°) to (1.2×350°) twist angle of teeth 12*b* of rotor 12, angle $\beta$ has been found to range between 45° and 65°.

Figure 10:
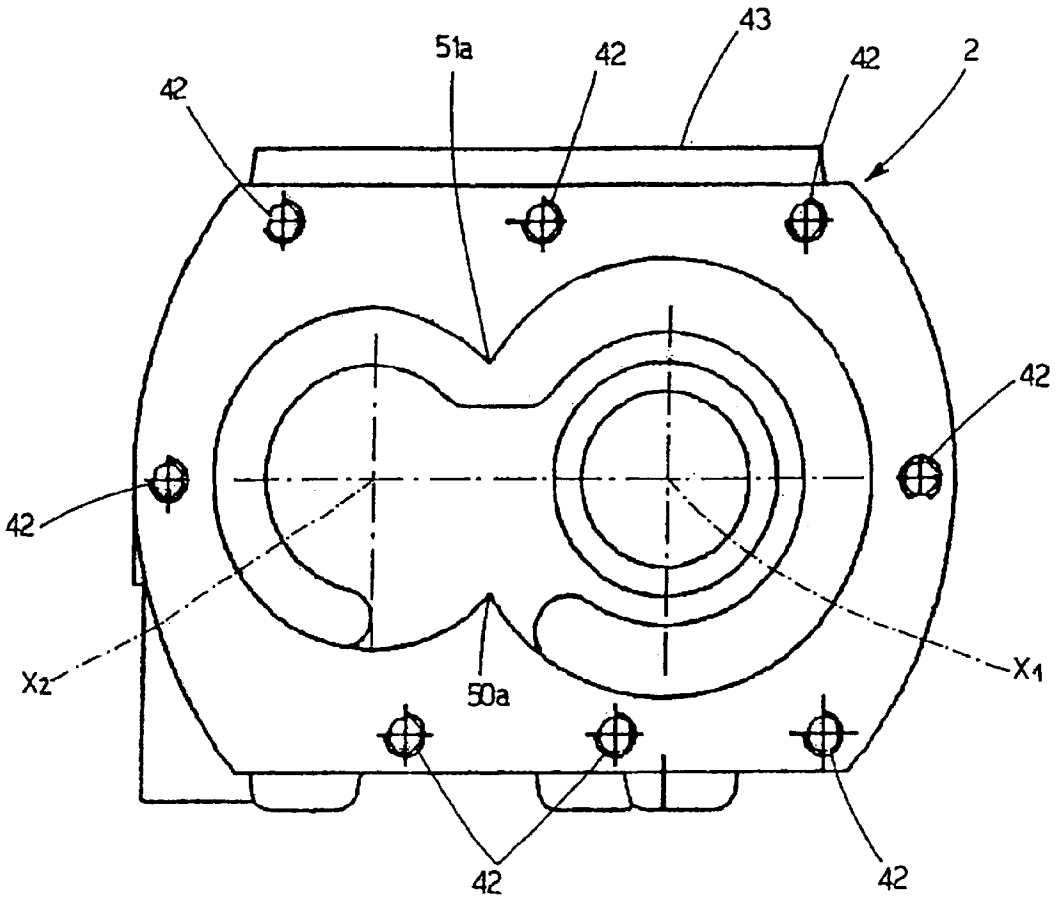
FIG. 10 shows a front view (not to scale) of the FIG. 9 rotor body casing.

In addition to cusp 50*a*, the inner surface 22 of casing 10 also has a second cusp 51*a* (FIGS. 10, 11) opposite the first, and which extends longitudinally along only a portion of the length of rotor body 2, again in the direction of axes $X_1$, $X_2$.

Figure 12:
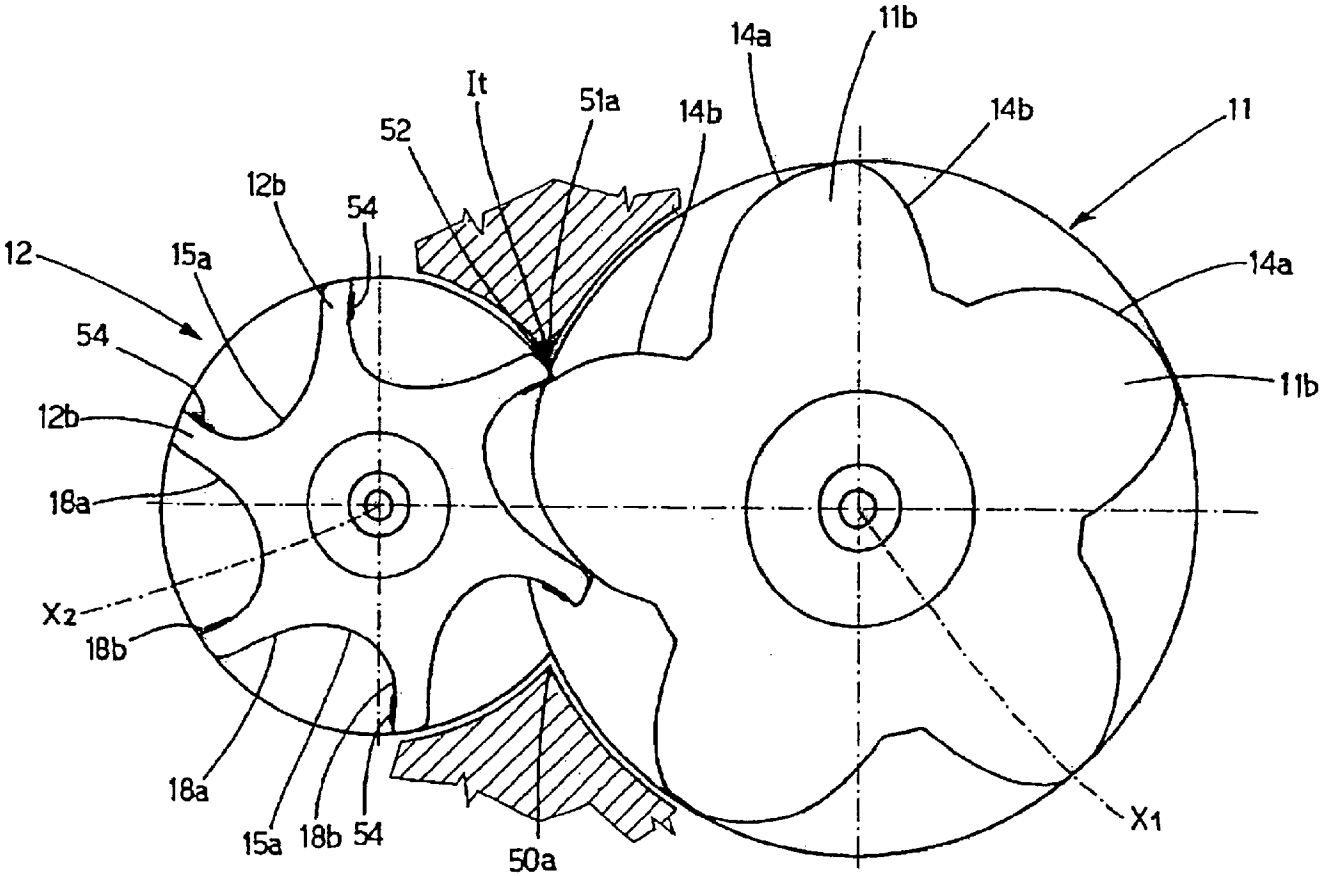
FIG. 12 shows the gap formed between the initially meshing ends of the male and female rotor teeth and a cusp on the inner surface of the rotor body casing.
Figure 13:
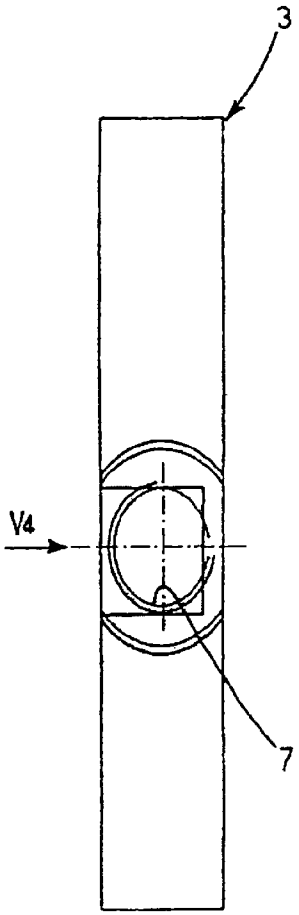
FIG. 13 shows a top plan view of the delivery body.

As shown in FIG. 12, to avoid any cooling gas bypass areas which, in the case of low-power compressors 1, would cause the cooling gas to be fed back to intake conduit 6, the end edges of teeth 11*b* and 12*b* are so formed as to minimize as far as possible a three-dimensional gap 52 between the end edges of teeth 11*b*, 12*b* and cusp 50*a* or 51*a*.

Starting from an ideal point $1_t$ located, in the FIG. 12 plane, inside gap 52, and given the substantially bicylindrical shape of inner surface 22, the two-dimensional profiles of teeth 11*b*, 12*b* may therefore be traced using known methods and subsequently developed in space.

Moreover, for improved filling of casing 10, a second intake chamber 53 has inventively been provided on the opposite side of ideal compression plane $P_c$ with respect to first intake chamber 45.

Part of the cooling gas admitted by conduit 6 is therefore fed to second intake chamber 53 and compressed in said flow direction indicated by arrow F (FIG. 4).

To improve fill even further, second intake chamber 53—which is substantially in the form of a pair of crossed rings—is so formed that its starting point $C_3$ in ideal plane $P_c$ is shifted by an angle $\gamma$ obtained by rotating a radius $r_3$—of a value substantially equal to $D_{em}/2$—clockwise and perpendicularly to axis $X_1$ of rotor 11 (FIG. 11), so as to form, on the male rotor 11 side, a first delay region 53*a* to improve filling of body 2. Without first delay region 53*a*, the high rotation speeds of rotors 11, 12 could form low-pressure pockets inside body 2, so that the cooling gas is again fed towards intake conduit 6 as opposed to delivery conduit 7. In other words, first delay region 53*a* is defined angularly by angle $\epsilon$ between point $C_1$ and point $C_3$.

For the same purpose, the end point $C_4$ of second intake chamber 53 in plane $P_c$ is also shifted clockwise by an angle $\delta$ with respect to a radius $r_4$ perpendicular to axis $X_2$ of rotor 12 (FIG. 11), so as to define a second delay region 53*b* defined by an angle $\lambda$ which gives the distance between point $C_2$ and point $C_4$.

For an air compressor 1—air being the most difficult gas to compress—tests have shown the best results to be obtained with an angle $\gamma$ of 25° to 35°, and with an angle $\delta$ of 5° to 15°.

The efficiency of rotary compressor 1 according to the present invention was found to range between 0.87 and 0.90, i.e. comparable with that of larger, higher-power rotary compressors.

To minimize three-dimensional gap 52 as far as possible, teeth 12*b* of female rotor 12 are formed with a very small rounding radius.

Also, to minimize the clearances between rotors 11, 12 and inner surface 22, active side 18*b* of each tooth 12*b* of female rotor 12 has a portion 54 (FIG. 8) coated with low-friction material, such as TEFLON, deposited galvanically. Portion 54 ranges from 0.03 mm to 0.07 mm in thickness, and is defined in an annulus of a maximum diameter $D_{max}$=0.716 $D_{em}$ and a minimum diameter $D_{min}$= 0.65 $D_{em}$.

Male rotor 11, on the other hand, is ion bombarded with a titanium-nitride-based compound using a PVD (Physical Vapor Deposition) process to obtain an extremely hard outer surface.

The mating of titanium-nitride-coated teeth 11*b* and portions 54 of teeth 12*b* provides for reducing said clearances.

Figure 18:
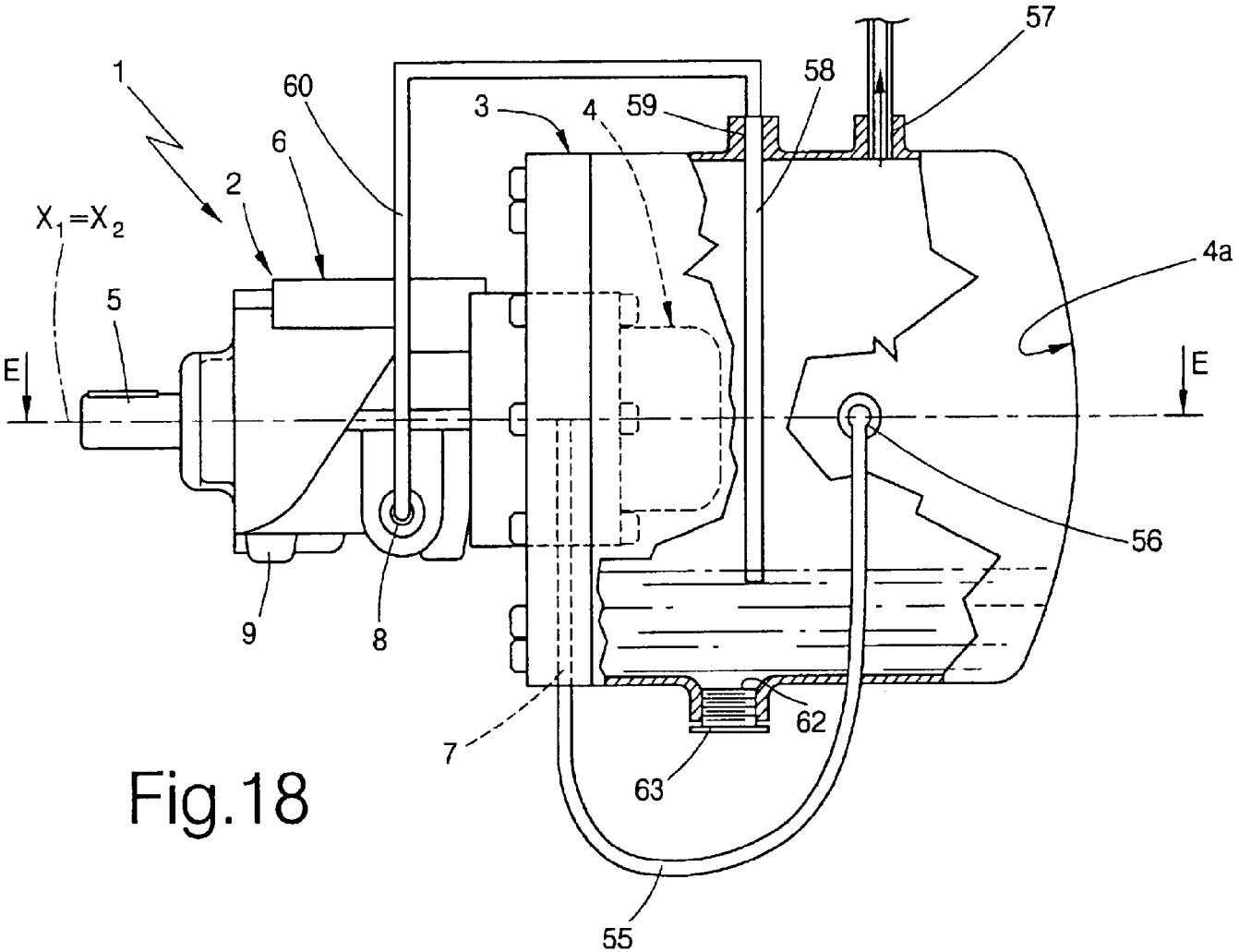
FIG. 18 shows a second embodiment of the compressor according to the present invention, in which is provided a separation chamber for knockout removal of the lubricating liquid from the gas.
Figure 19:
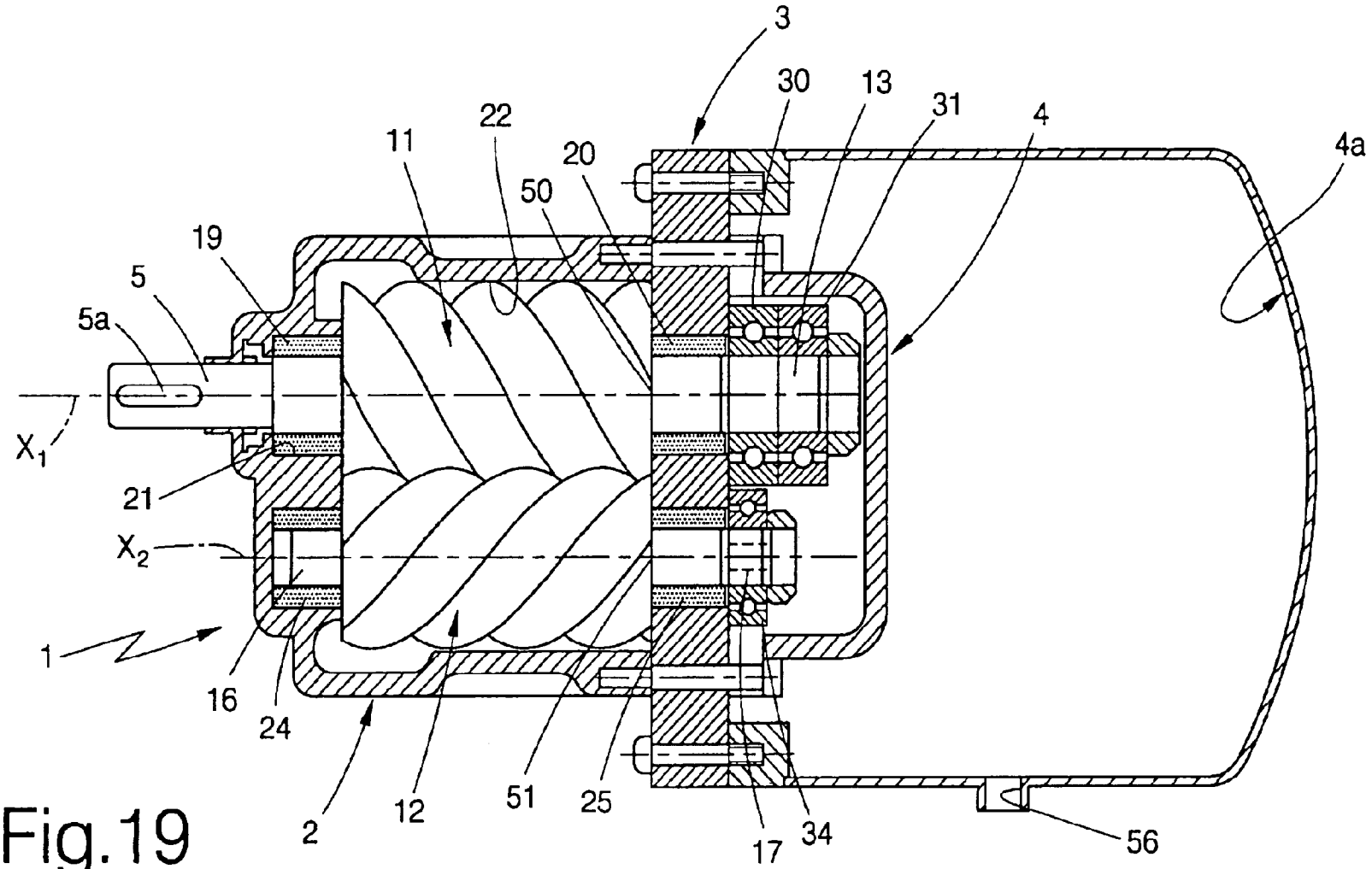
FIG. 19 shows a longitudinal section E—E of the second embodiment in FIG. 18.

FIGS. 18, 19 show an alternative embodiment to the one described with reference to FIGS. 1–17.

Wherever possible, the same reference numbers as in the first embodiment are also used in the second.

The main difference between the first and second embodiment lies in the flange of lateral cover body 3, which, in the second embodiment, is enlarged to connect a separating chamber 4*a* by which to separate the cooling gas from the liquid lubricant.

In the second embodiment also, the cooling gas and the liquid lubricant are fed into casing 10 by intake conduit 6 and injection conduit 8 respectively.

The cooling gas/liquid lubricant mixture compressed in rotor body 2 is fed to body 4 along delivery conduit 7 and a pipe 55 connected to the delivery conduit, and is fed into separation chamber 4*a* through an inlet 56 in a lateral wall of chamber 4*a*. Chamber 4*a* also has a delivery outlet 57 for the compressed gas separated at least partially from the liquid lubricant which, as a result of the swirl produced inside chamber 4*a*, settles by force of gravity on the bottom of chamber 4*a*. By means of a dip pipe 58 through a further outlet 59 in chamber 4*a*, the deposited liquid lubricant is fed back along a conduit 60 to injection conduit 8 and recirculated.

A hole 62 with a screw cap 63 is provided at the bottom of chamber 4*a* to drain off the liquid lubricant.

In the second embodiment in FIGS. 18 and 19, separating the liquid lubricant and the cooling gas immediately in chamber 4*a* and at compressor 1 greatly simplifies the cooling gas/liquid lubricant processing system downstream from compressor 1.

The advantages of the present invention are as follows:

optimum filling of casing 10 of rotor body 2;

reduction in the size of gaps 52 to prevent the cooling gas from being fed back to intake conduit 6;

no clearance between rotors 11 and 12 or between rotors 11, 12 and the inner surface 22 of rotor body 2;

0.87 to 0.90 efficiency, comparable with that of larger rotary compressors; and as regards the second embodiment, immediate separation of the liquid lubricant and cooling gas at compressor 1, thus simplifying the cooling gas/liquid lubricant processing system downstream from compressor 1.

Although the aforesaid description has been particularly focused on a cooling gas suitable for low-power systems, it is evident for a man skilled in the art to apply the teaching of the present invention to any screw compressor able to handle any kind of gas, in particular, air.

What is claimed is:

1. A gas rotary screw compressor comprising a casing having an intake conduit and a delivery conduit, said casing also having an inner surface and housing a male rotor with a longitudinal axis of symmetry and a female rotor with a longitudinal axis of symmetry, said male and female rotors having respective helical teeth;

wherein the meshing line of said male rotor with said female rotor substantially lies in a central plane of said intake conduit, said plane passing through the center of said intake conduit and being simultaneously parallel to said axes;

wherein at least one portion of the inner surface of the casing is shaped to follow the outer profile of said helical teeth so as to define a first intake chamber, to minimize, in said first intake chamber, the load losses of the gas as the gas flows towards said male and female rotors; and wherein said first intake chamber follows the helical shape of said male and female rotors up to an ideal compression plane inside said casing;

the compressor being characterized by the fact that it also provides a second intake chamber which is located behind said first intake chamber with respect to said ideal compression plane in order to fill said casing with a maximum quantity of gas, and wherein, on the male rotor side, a point at which said first intake chamber intersects said ideal compression plane is separated by an angle $\alpha$ from a cusp on said inner surface.

2. A compressor as claimed in claim 1 wherein, for a 270° to 350° twist angle of the teeth of the male rotor, said angle $\alpha$ ranges between 50° and 80°.

3. A compressor as claimed in claim 1 wherein, on the female rotor side, a point at which said first intake chamber intersects said ideal compression plane is separated by an angle $\beta$ from a cusp on said inner surface.

4. A compressor as claimed in claim 3 wherein, for a (1.2×270) to (1.2×3500) twist angle of the teeth of the female rotor, said angle $\beta$ ranges between 45° and 65°.

5. A compressor as claimed in claim 1 wherein one end of said male rotor and one end of said female rotor rest on said ideal compression plane.

6. A compressor as claimed in claim 5 wherein projection of said second intake chamber onto said ideal compression plane defines a first point and a second point.

7. A compressor as claimed in claim 6 wherein said first point is separated by an angle $\gamma$ from a radius perpendicular to a longitudinal axis of symmetry of said male rotor.

8. A compressor as claimed in claim 7 wherein said angle $\gamma$ ranges between 25° and 35°.

9. A compressor as claimed in claim 6 wherein said second point is separated by an angle $\delta$ from a radius perpendicular to a longitudinal axis of symmetry of said female rotor.

10. A compressor as claimed in claim 9 wherein said angle $\delta$ ranges between 5° and 15°.

11. A compressor as claimed in claim 1 wherein said compressor comprises a rotor body, a delivery body and a lateral cover body connected to one another by mechanical fastening means.

12. A compressor as claimed in claim 11 wherein said rotor body comprises an injection conduit for injecting a liquid lubricant.

13. A compressor as claimed in claim 12 wherein a separation chamber is provided for separating the liquid lubricant from the gas.

14. A compressor as claimed in claim 13 wherein the gas/liquid lubricant mixture is fed into said chamber though a lateral inlet.

15. A compressor as claimed in claim 14 wherein the liquid lubricant deposited at the bottom of said chamber is recycled to said injection conduit.

16. A compressor as claimed in claim 11 wherein said male rotor and said female rotor are housed inside said rotor body.

17. A compressor as claimed in claim 11 wherein said male rotor is formed integrally with two respective shafts, and said female rotor is formed integrally with two respective shafts.

18. A compressor as claimed in claim 17 wherein a first of said shafts of the male rotor is supported by a first supporting member with a low friction coefficient, while a second of said shafts of the male rotor is supported by a second supporting member with a low friction coefficient, and by a pair of bearings locked by means of a ring nut.

19. A compressor as claimed in claim 18 wherein said first supporting member is housed in a seat inside the casing of said rotor body, said second supporting member is housed in a seat in said delivery body, and the pair of bearings and the ring nut are housed in a seat in said lateral cover body.

20. A compressor as claimed in claim 17 wherein a first of said shafts of the female rotor is supported by a third supporting member with a low coefficient of friction, while a second of said shafts of the female rotor is supported by a fourth supporting member with a low coefficient of friction, and by a bearing locked by means of a ring nut.

21. A compressor as claimed in claim 20 wherein said third supporting member is housed in a seat in the casing of said rotor body, said fourth supporting member is housed in a seat in said delivery body, and the bearing and the ring nut are housed in a seat in said lateral cover body.

22. A compressor as claimed in claim 1 wherein an active side of each tooth of said female rotor is at least partially coated with a low-friction-coefficient material, such as TEFLON, deposited by means of a galvanic process.

23. A compressor as claimed in claims 1 or 22 wherein the teeth of said male rotor are coated with a titanium-nitride-based compound deposited by a PVD method.

24. A compressor as claimed in claims 1 wherein, on the male rotor side, a point at which said first intake chamber intersects said ideal compression plane is separated by an angle $\alpha$ from a first cusp on said inner surface, wherein, on the female rotor side, a point at which said first intake chamber intersects said ideal compression plane is separated by an angle $\beta$ from a second cusp on said inner surface; and wherein the extension of a region, defined by any one tooth of the male rotor and any one tooth of the female rotor approaching one of the two cusps, is limited to prevent the formation of gas bypass regions.

25. A compressor as claimed in claim 1 wherein the outside diameter ($D_{ef}$) of said female rotor equals the rolling diameter ($D_r$).

26. A compressor as claimed in claim 1 wherein said gas is a cooling gas, suitable for low-power systems.

27. A gas rotary screw compressor for compressing a gas, comprising:

a casing having an intake conduit and a delivery conduit, said casing also having an inner surface and housing a male rotor with a longitudinal axis of symmetry and a female rotor with a longitudinal axis of symmetry, said male and female rotors having male and female helical teeth, said male and female rotors defining a helical shape, at least one portion of the inner surface of the casing being shaped to follow the outer profile of said male and female helical teeth so as to define, along with an ideal compression plane, a first intake chamber so as to minimize the load losses of the gas in said first intake chamber as the gas flows towards said male and female rotors;

said male and female rotors meshing and defining a meshing line thereby, said meshing line lying substantially in a central plane of said intake conduit, said central plane passing through the center of said intake conduit and being simultaneously parallel to said axes; and a second intake chamber located behind said first intake chamber with respect to said ideal compression plane in order to fill said casing with a maximum quantity of gas;

wherein said first intake chamber follows the helical shape of said male and female rotors up to an ideal compression plane inside said casing and one end of said male rotor and one end of said female rotor lie on said ideal compression plane;

wherein said male rotor comprises two shafts and said female rotor comprises two shafts, a first of said shafts of said male rotor being supported by a first supporting member having a low friction coefficient, a second of said shafts of said male rotor being supported by a second supporting member having a low friction coefficient and wherein on the male rotor side, a point at which said first intake chamber intersects said ideal compression plane is separated by an angle $\alpha$ from a cusp on said inner surface, said angle $\alpha$ be inn between 50° and 80°.

28. The compressor of claim 27 wherein, on the female rotor side, a point at which said first intake chamber intersects said ideal compression plane is separated by an angle $\beta$ from a cusp on said inner surface, said angle $\beta$ being between 45° and 65°.

29. The compressor of claim 27 wherein projection of said second intake chamber onto said ideal compression plane defines a first point and a second point, said first point being separated by an angle $\gamma$ from a radius that perpendicular to a longitudinal axis of symmetry of said male rotor, said angle $\gamma$ being between 25° and 35°.

30. The compressor of claim 27 wherein said second point is separated by an angle $\delta$ from a radius perpendicular to a longitudinal axis of symmetry of said female rotor, said angle $\delta$ being between 5° and 15°.

* * * * *